United States Patent [19]

Vernon

[11] Patent Number: 4,712,369

[45] Date of Patent: Dec. 15, 1987

[54] YARN TREATING DEVICE FOR OPEN-END SPINNING FRAMES

[75] Inventor: Thomas Vernon, Greensboro, N.C.

[73] Assignee: Burckhardt America, Inc., Greensboro, N.C.

[21] Appl. No.: 48,212

[22] Filed: May 11, 1987

[51] Int. Cl.[4] ..... D01H 7/882; D01H 1/135

[52] U.S. Cl. ..... 57/417; 57/414; 57/415

[58] Field of Search ..... 57/404, 411, 414–417, 57/352

[56] References Cited

U.S. PATENT DOCUMENTS

| | | | |
|---|---|---|---|
| 4,011,712 | 3/1977 | Egbers et al. | 57/417 |
| 4,258,541 | 3/1981 | LeChatelier et al. | 57/417 |
| 4,385,488 | 5/1983 | Raasch et al. | 57/417 |
| 4,499,719 | 2/1985 | Faessler | 57/417 |
| 4,516,397 | 5/1985 | Raasch et al. | 57/417 |
| 4,665,687 | 5/1987 | Ott et al. | 57/417 |

*Primary Examiner*—John Petrakes

*Attorney, Agent, or Firm*—Charles E. Rhodes; Judith E. Garmon

[57] ABSTRACT

An improved navel member positioned in the cover of the spinning rotor of an open-end spinning frame includes a barrel having a longitudinal passageway extending therethrough. The axis of the passageway is substantially coincident with the thread path as it exits the spinning rotor. A cylindrical insert is fixed in the barrel passageway and includes a longitudinal channel therethrough through which the thread actually passes. A plurality of spaced longitudinal grooves in the inside wall surrounding the longitudinal channel receive elongated ceramic rods partially embedded therein. The rods form a plurality of spaced obstructions around the periphery of the longitudinal channel. The periphery of yarn passing through the navel member intermittently engages and disengages the ceramic rods causing an improved roughening and bulking effect.

5 Claims, 6 Drawing Figures

YARN TREATING DEVICE FOR OPEN-END SPINNING FRAMES

BACKGROUND AND SUMMARY OF THE PRESENT INVENTION

This invention is directed to open-end spinning, and more particularly to an improvement in the thread delivery system which guides the thread initially formed in the fiber collecting groove of the spinning rotor of an open-end spinning machine therethrough to a pickup mechanism. In accordance with the invention an improved roughing and bulking effect on the yarn, as well as better control over the exiting yarn, is obtained.

Open-end spinning is a fiber preparation technique which originated in Europe and has received widespread acceptance in the last twenty - twenty-five years. Open-end spinning is a distinctly faster operation than other yarn preparation techniques such as "ring" spinning; however, it has several disadvantages. One disadvantage is that it is difficult to eliminate yarn breakages or "ends down." Another disadvantage is that open-end spinning techniques generally do not result in a yarn having a "soft" hand. Threads produced in openend spinning rotors exhibit less hairy or fuzzy texture and have less bulk. In the case of knitted and woven apparel goods, a soft hand is required. As a result yarns intended for certain knitted and woven apparel fabrics have not achieved widespread acceptance from open-end spinning systems.

For these and other reasons, it has been previously attempted to obtain a softer hand and eliminate ends down situations by introducing one or more obstacles in the path of the yarn as it leaves the spinning rotor through the delivery tube. At such times the spinning rotor causes the yarn to rotate around the inner periphery of the delivery tube as it passes therethrough engaging such obstacles as it rotates. This results in some surface treatment of the yarn. Such approaches are illustrated in U.S. Pat. Nos. 4,258,541 to Le Chatelier et al; 4,011,712 to Egbers et al; and 4,516,397 to Raasch et al.

While such approaches have resulted in improvements to the hand softness and have resulted in some elimination of ends down situations, there remain certain unsolved problems. For example, the number of ends down is still higher than desired. The resulting yarn tends to shed as a result of encountering the aforesaid obstacles. It is very difficult and expensive to obtain yarns having extremely soft hand or varying degrees of softness from one yarn type to another yarn type. Also, the resulting yarns tend to lack uniformity along their length in that there are rough spots (thick and thin places) in the resulting yarn.

With this in mind, the present invention is an attempt to provide a superior yarn (1) by improving the interior configuration of the navel member leading to the yarn delivery tube, and (2) by altering the manner in which the aforesaid navel member is constructed. In general, in accordance with the present invention there is provided a cylindrical yarn treating insert which is formed separately, but then fixed in the barrel portion of the navel member. The navel member, as used herein, is defined as the member generally mounted in the rotor cover into which the yarn initially passes as it leaves the yarn collection surface of the rotor and through which the yarn passes as it proceeds to the yarn delivery tube and/or take-up mechanism.

In the approach of the present invention a navel yarn treating insert is fabricated separately, then fixed in the barrel portion of the navel member. The aforementioned insert includes a longitudinal channel passing centrally therethrough, and the inner wall is provided with a plurality of peripherally spaced grooves therein. Each groove receives a ceramic rod therein, and a portion of the periphery of such rods is embedded in the aforementioned channel to provide a pattern of obstructions to the yarn as it passes therethrough. The depth of the grooves may be changed or altered by design from insert to insert, which results in the rods being embedded to a greater or lesser extent. This naturally results in a greater or lesser offset between the rods which determines the degree of roughness in the yarns passing therethrough, as well as allowing for some compensation for differences in yarn size.

The above-described insert is formed separately from the ceramic throat piece, which throat piece is embedded in the front surface of the navel member. Separation of the fabrication of the throat piece and insert results in manufacturing economies. All throat pieces may be formed of the same dimension, yet are compatible with inserts having differing interior rod configurations. Thus, in the manufacture of the navel members a single size and shape of housing may be formed, a single size of ceramic throat piece may be molded, yet easily combined with several insert/rod configurations.

It has been found that the navel members formed in accordance with the present invention result in fewer ends down situations, minimize yarn shedding, provide yarn with a very soft hand where desired, and results in a more uniform yarn diameter throughout the length. Further, by merely varying the distance between the rods varying types of yarn softness characteristics may be achieved.

It is therefore an object of the present invention to provide a unique and improved construction for the navel member of open-end spinning frames.

It is another object of the present invention to provide a navel member of the type described which results in a softer hand and a higher quality thread output.

Other objects and a fuller understanding of the invention will become apparent from reading the following detailed description of a preferred embodiment, along with the accompanying drawings in which.

DETAILED DESCRIPTION OF A PREFERRED EMBODIMENT

Figure 1:
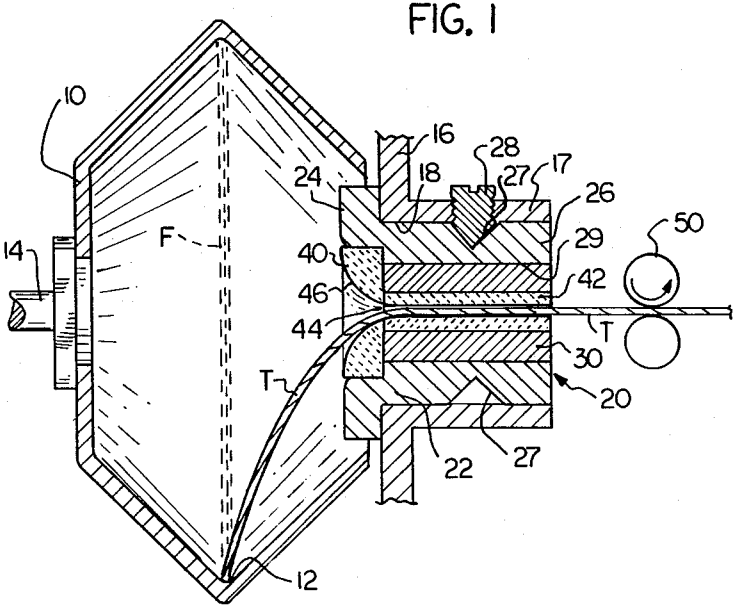
FIG. 1 is a sectional view of an open-end spinning rotor having a thread delivery device mounted therein in accordance with the present invention.
Figure 2:
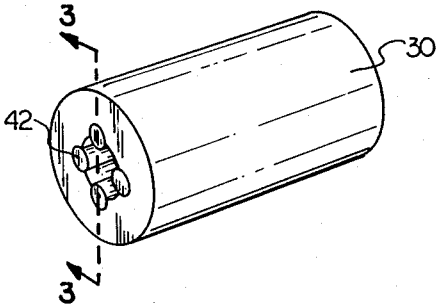
FIG. 2 is a perspective view of the yarn treating insert removed from the navel member.

Turning now to the drawings there is illustrated in FIG. 1 the thread delivery device 20 inserted in the spinning rotor of an open-end spinning machine illustrative of the type with which the present invention is intended for use. The open-end spinning device is of a generally conventional design which includes a spinning rotor 10 having a fiber collecting groove 12 in which the fibers F are initially deposited. The rotor is turned by a drive shaft 14 at very high speeds 40,000 rpms and greater. The fibers F form a thread T which is pulled through the thread delivery device 20 by a take-up mechanism 50. The housing of rotor 10 is generally open on the side opposite the drive shaft 14, and is covered by a cover 16 having an opening 18 therein with a hub 17 extending rearwardly therefrom.

The thread delivery device or navel member of the present invention is inserted in the opening 18 and cover 16 as illustrated in FIG. 1. The navel member includes a support housing 22 having a head 24 at the upstream end thereof and a barrel 26 protruding in a downstream direction from the rear side of head 24. Housing 22 is retained within the cover member 16 by a set screw 28 which extends through a threaded opening in hub 17 and engages a peripheral groove 27 in barrel 26. In some types of open-end spinning machines, the hub 17 would have an internal thread and the barrel 26 would be externally threaded to cooperate therewith. Barrel 26 is provided with a longitudinal passageway 29 therethrough, the axis of which extends substantially coiincident with the thread path as it exits the spinning rotor 10.

A ceramic throat piece 40 is embedded in the front surface of head 24 and includes a central guide orifice 44 therein for guiding the thread into the aforesaid passageway. The throat piece 40 also includes a generally sloping depression 46 leading to the orifice 44, giving the member 20 the appearance of and the basis for the name "navel."

Figure 3:
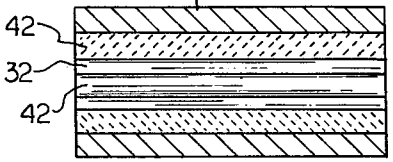
FIG. 3 is a sectional view of a first type of insert.

A generally cylindrical insert 30 is fixed in the passageway 29 of barrel 26 and includes a smaller longitudinal channel therethrough having a diameter equal to or less than the diameter of the central guide orifice 44 of throat member 40. The internal wall 32 of insert 30 is provided with a plurality of peripherally spaced, longitudinal grooves 34 formed therein (FIG. 3). The pattern of grooves 34 in the inner wall 32 extends parallel to and surrounds the yarn path. Each longitudinal groove 34 is provided with an elongated ceramic rod 42 partially embedded therein. The inner wall 34 of insert 30 along with the exposed surfaces of rods 42 form a plurality of spaced obstructions around the periphery of said longitudinal channel. Such obstructions intermittently engage and disengage the yarn passing through the navel member causing an improved roughening and bulking effect.

Figure 4:
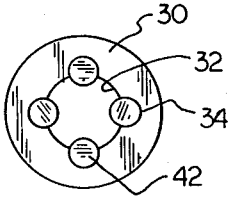
FIG. 4 is an end view of the insert of FIG. 3 illustrating the manner in which the ceramic rods may be embedded relatively deeply.

The insert is better described by reference to FIGS. 2–6. A first type of insert is illustrated in FIGS. 3 and 4. In this embodiment, the grooves 34 extend throughout the entire length of insert 30. Looking particularly at FIG. 4, it can been seen that the rods 42 are embedded relatively deeply into the grooves 34. This results in less of an obstacle or obstruction to the yarn rotation as it passes through the navel member 20.

Figure 5:
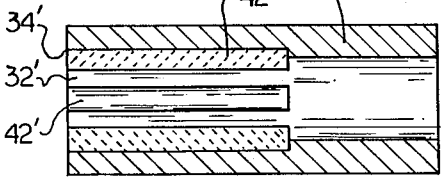
FIG. 5 is a sectional view of a second embodiment of the insert.
Figure 6:
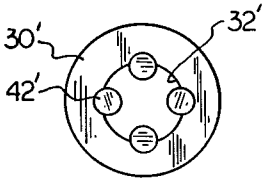
FIG. 6 is an end view of the second type of insert illustrating the manner in which the rods may be embedded relatively shallowly therein.

Turning now to FIGS. 5 and 6 there is illustrated an alternative embodiment of the insert 30' which includes grooves 34' and ceramic rods 42' of a length less than that of the entire length of the insert. Preferably, the rods are located at the upstream or inlet end of the insert 30' adjacent the throat piece 40. In FIG. 6, it can be seen that the rods 42' may be embedded less deeply into grooves 34, and therefore form greater obstacles for the yarn passing through the navel member 20. The variance in the depth of embedding of the ceramic rods permits the processing of differing types of yarn from the standpoint of hand.

It should also be noticed that the rear end of insert 30 is flat and substantially co-planar, rather than being tapered or funnel-shaped. This provides enhanced results in the yarn exiting the navel member 20.

While the invention has been described in detail hereinabove, it is obvious that various changes and modifications might be made to the specific features illustrated and described without departing from the scope of the invention, which is set forth in the following claims.

What is claimed is:

1. A navel member adapted for attachment in the cover of an open-end spinning rotor for guiding thread formed in the fiber collecting groove of said spinning rotor of an open-end spinning machine therethrough to a take-up mechanism, said navel member including:

(a) a support housing having a head at the upstream end and a barrel protruding in a downstream direction from the rear side of said head, said barrel including a passageway therethrough, the axis of said passageway extending substantially along the thread path as it exits said spinning rotor, means associated with said barrel for mounting said housing in position adjacent the spinning rotor;

(b) a ceramic throat piece embedded in the front surface of said head and including a central guide orifice therein for guiding thread into said passageway;

(c) a generally cylindrical insert fixed in said barrel passageway and including a longitudinal channel therethrough having a diameter equal to or less than the diameter of said central guide orifice;

(d) a plurality of spaced, substantially inside wall of said longitudinal channel, said plurality of grooves surrounding the yarn path therethrough;

(e) an elongated ceramic rod partially embedded in each of said grooves and forming a plurality of peripherally spaced obstructions around the wall forming said longitudinal channel;

(f) whereby the yarn exiting said spinning rotor through said navel member intermittently engages said ceramic rods causing an improved roughening and bulking effect.

2. The navel member according to claim 1 wherein the cross-sectional dimensions of said rods and said grooves are such that said rods may be initially embedded in said grooves to varying depths in order to achieve a prescribed degree of exposure of said rods in said channel.

3. The navel member according to claim 1 wherein said cylindrical insert includes a substantially flat planar rear end and the termination of said elongated rods are co-terminal with said flat rear end.

4. The navel member according to claim 1 wherein said elongated rods and associated longitudinal grooves extend the entire length of said insert member.

5. The navel member according to claim 1 wherein said rods and associated longitudinal grooves are of a shorter dimension than the length of said insert.

* * * * *